US012188177B2

(12) United States Patent
Reisinger et al.

(10) Patent No.: US 12,188,177 B2
(45) Date of Patent: Jan. 7, 2025

(54) APPARATUS FOR GRINDING A FIBROUS MATERIAL SUSPENSION

(71) Applicant: ANDRITZ AG, Graz (AT)

(72) Inventors: Thomas Reisinger, Graz (AT); Peter Ortner, Graz (AT); Daniel Hogue, St-Lin-Laurentide (CA); Christian Harpin, Boisbriand (CA)

(73) Assignee: ANDRITZ AG, Graz (AT)

( * ) Notice: Subject to any disclaimer, the term of this patent is extended or adjusted under 35 U.S.C. 154(b) by 284 days.

(21) Appl. No.: 17/798,133

(22) PCT Filed: Mar. 12, 2021

(86) PCT No.: PCT/EP2021/056317
§ 371 (c)(1),
(2) Date: Aug. 8, 2022

(87) PCT Pub. No.: WO2021/197805
PCT Pub. Date: Oct. 7, 2021

(65) Prior Publication Data

US 2023/0047528 A1 Feb. 16, 2023

(30) Foreign Application Priority Data

Apr. 1, 2020 (AT) ..... A 50275/2020

(51) Int. Cl.
*B02C 7/14* (2006.01)
*D21D 1/30* (2006.01)

(52) U.S. Cl.
CPC ..... *D21D 1/303* (2013.01)

(58) Field of Classification Search
CPC ..... D21D 1/30; D21D 1/303; B02C 7/14
See application file for complete search history.

(56) References Cited

U.S. PATENT DOCUMENTS 3,323,731 A * 6/1967 Arne ..... D21D 1/303 241/261.2
3,841,573 A * 10/1974 Kahmann ..... D21D 1/303 241/245
3,977,611 A * 8/1976 Sjobom ..... D21D 1/30 241/251

(Continued)

FOREIGN PATENT DOCUMENTS

DE 202006002999 U1 6/2007
GB 745987 3/1956

(Continued)

OTHER PUBLICATIONS

International Search Report mailed May 27, 2021 for International Patent Application No. PCT/EP2021/056317.

*Primary Examiner* — Faye Francis
(74) *Attorney, Agent, or Firm* — Alix, Yale & Ristas, LLP

(57) ABSTRACT

A refiner for refining pulps, includes a shaft, a rotor disc attached firmly to the shaft and a shaft bearing, the rotor disc being disposed between two stator discs and forming a refining chamber between the rotor disc and the stator discs. The shaft is movable in an axial direction and the shaft bearing is connected hydraulically to the refining chamber, ensuring low wear on the rotor discs and stator discs and, in particular, on the refiner plates on these discs, also in continuous operation.

20 Claims, 5 Drawing Sheets

(56) References Cited

U.S. PATENT DOCUMENTS

| | | | | | |
|---|---|---|---|---|---|
| 4,036,443 | A | * | 7/1977 | Saltarelli | B02C 7/12 241/297 |
| 4,081,147 | A | * | 3/1978 | Seifert | D21D 1/303 241/261.3 |
| 4,083,503 | A | * | 4/1978 | Langdon | D21D 1/303 241/259.1 |
| 4,269,365 | A | * | 5/1981 | Berggren | B02C 7/11 241/247 |
| 4,283,252 | A | * | 8/1981 | Reinhall | D21D 1/30 241/23 |
| 4,457,804 | A | * | 7/1984 | Reinhall | D21B 1/12 241/245 |
| 4,700,900 | A | * | 10/1987 | Rowland | D21D 1/30 162/28 |
| 5,011,091 | A | * | 4/1991 | Kopecky | D21D 1/303 241/261.3 |
| 5,323,972 | A | * | 6/1994 | Kjellqvist | B02C 7/14 241/37 |
| 5,445,328 | A | * | 8/1995 | Musselman | D21D 1/303 241/245 |
| 5,472,285 | A | * | 12/1995 | Kjellqvist | D21D 1/30 384/563 |
| 5,564,634 | A | * | 10/1996 | Rouse | B02C 7/06 241/261.3 |
| 5,762,275 | A | * | 6/1998 | Aikawa | D21D 1/303 241/297 |

FOREIGN PATENT DOCUMENTS

| | | |
|---|---|---|
| GB | 946390 | 1/1964 |
| GB | 1059781 | 2/1967 |

* cited by examiner

APPARATUS FOR GRINDING A FIBROUS MATERIAL SUSPENSION

CROSS-REFERENCE TO RELATED APPLICATION

This application is a U.S. National Stage entry of International Patent Application No. PCT/EP2021/056317, which claims priority to Austrian Patent Application No. A50275/2020, filed Apr. 1, 2020, now Austrian Patent No. AT523590.

BACKGROUND

The disclosure relates to a refiner for refining pulps in a fibre pulp suspension, comprising a shaft, a rotor disc attached firmly to the shaft, and a shaft bearing, the rotor disc being disposed between two stator discs and forming a refining chamber between the rotor disc and the stator discs, the shaft being movable in an axial direction, at least one stator disc being slidable in axial direction, the size of the refining chamber being adjustable by means of the spacing between the stator discs, and the rotor disc being movable between the stator discs by moving the shaft in axial direction.

Refiners—or rather the double-disc refiners described—are known with different designs. Typically, a rotor disc rotates between two stationary stator discs, the rotor disc and the stator discs being fitted with refiner plates. The pulp in the suspension is refined in the refining chamber between the rotor disc and the stator discs. Even distribution of the refining pressure in the refining chamber, and thus in the area between the rotor disc and the first stator disc as well as in the area between the rotor disc and the second stator disc, is essential. For this purpose, the rotor must be movable in axial direction. Various solutions are known in the state of the art.

For example, DE 20 2006 002 999 U1 describes a disc refiner for refining a pulp material. Details of the rotor and stator are described, the rotor having a supporting disc that can be displaced on the rotor shaft in axial direction, for example by means of axial toothing. The supporting disc and hence the entire rotor can align freely in axial direction. It is explained that it can also be favourable if the rotor itself can be displaced in axial direction.

SUMMARY

Provided herein is a refiner with reduced wear on the rotor discs and stator discs, and, in particular, on the refiner plates on these discs.

This is achieved in that the shaft bearing is connected hydraulically to the refining chamber. In this case, "connected hydraulically" means that a fluid—preferably water—can be transferred between the shaft bearing and the refining chamber. As a result, continuous stream filaments of the fluid—hydraulically speaking—can be shown or are present between the shaft bearing and the refining chamber. Surprisingly, it appears that the shaft can be moved particularly smoothly in axial direction if the shaft bearing is connected hydraulically to the refining chamber. In particular, this smooth movement is also retained when the refiner is in operation. The smooth axial movement of the shaft and thus of the rotor disc firmly attached to the shaft is an essential prerequisite for the pulp present in a suspension being refined evenly in the refining chamber, i.e. in the area between the rotor disc and the first stator disc and in the area between the rotor disc and the second stator disc, because the refining pressure is evenly distributed in the refining chamber. Even distribution of the refining pressure results here from the autonomous and smooth positioning of the rotor disc between the stator discs. Any resistance to positioning, e.g. by friction, is conducive to uneven distribution of the refining pressure, thus directly promoting uneven pulp refining and uneven wear on the rotor discs and stator discs, this wear affecting the refiner plates on the rotor disc and the stator discs in particular. The firm connection between the rotor disc and the shaft means that there is no axial mobility between the shaft and the rotor disc and thus, no relative motion in the axial direction between shaft and rotor disc. However, the connection between rotor disc and shaft can, of course, by designed so as to be detachable, which can be important for service and installation purposes.

A favourable embodiment of the refiner is characterized in that the rotor disc is firmly attached to the shaft inside or outside the shaft bearing. Hence, the shaft is supported on both sides of the rotor disc or has an overhung arrangement. Supporting the refiner shaft on both sides of the rotor disc allows even and distributed bearing load, but not a very compact design as the shaft is supported on both sides of the rotor disc. If it has an overhung arrangement, the rotor shaft is firmly attached to the shaft at a first end of the shaft and the rotor disc is outside the shaft bearing. At a second end of the shaft, the shaft is connected to a motor via a coupling, the coupling being outside the shaft bearing. Advantageously, the overhung arrangement of the rotor disc together with the hydraulically connected shaft bearing disclosed herein allow a very compact design.

An advantageous embodiment of the refiner is characterized in that the shaft is supported entirely on fluid-lubricated plain bearings. This enables particularly smooth shaft movement in axial direction of the shaft. If the shaft is supported on both sides of the rotor disc, only fluid-lubricated plain bearings are disposed on either side of the rotor disc. If the shaft is supported in an overhung arrangement, one end of the shaft is attached firmly to the rotor disc and the shaft is supported entirely on fluid-lubricated plain bearings, the shaft bearing being disposed between the rotor disc and a second end of the shaft. Another favourable embodiment of the refiner is characterized in that the shaft bearing is designed as a fluid-lubricating plain bearing, where a fluid, preferably water, can be fed to the refining chamber via the shaft bearing. Design as a water-lubricated plain bearing is particularly advantageous. In accordance with the hydraulic connection between the shaft bearing and the refining chamber, as described herein, water can be fed to the refining chamber via the water-lubricated plain bearing. Using water as the fluid means that it is possible to support the shaft without using oil, thus excluding the risk of the pulp suspension being contaminated with oil, or rather hydraulic oil. Forced guidance is particularly advantageous in order to ensure that the flow direction of the fluid—preferably water—runs through the fluid-lubricated plain bearing into the refining chamber. Forced guidance of this kind can be achieved easily if the fluid in the shaft bearing has a higher pressure than the fibre pulp suspension in the refining chamber in the area where the fluid enters the refining chamber. Due to the higher pressure of the fluid in the shaft bearing, the fluid flows in the direction of the refining chamber, which has the advantage of effectively preventing the shaft bearing, or rather water-lubricated plain bearing, from being contaminated. Thus, the water-lubricated plain bearing is always flushed through in the direction of the refining chamber and the shaft retains its smooth mobility throughout operations. If the refiner shaft is supported on both sides of the rotor disc, the shaft bearing is designed as a fluid-lubricated plain bearing on either side of the rotor disc, where a fluid, preferably water, can be fed to the refining chamber via the shaft bearing.

Another favourable embodiment of the refiner is characterized in that a seal is disposed between the refining chamber and the shaft bearing. The shaft bearing is designed as a fluid-lubricated plain bearing, where a fluid, preferably water, can be fed through the shaft bearing via the seal to the refining chamber. An advantageous design of the seal comprises a rotary shaft seal or a throttle ring. For example, the seal is disposed between shaft and bearing housing, placed in a cut-out in the bearing housing and secured in the bearing housing by a fastening ring. The shaft passes through the seal, the seal coming into contact with the shaft if it is a rotary shaft seal and a gap being formed between shaft and seal if it is a throttle ring. It is an advantage if the seals have at least one sealing lip.

An advantageous embodiment of the refiner is characterized in that the sealing effect of the seal depends on the flow direction of the fluid. Rotary shaft seals or throttle rings are seals of this kind. The sealing effect dependent on the flow direction can be achieved if the fluid, or rather the fluid pressure, lifts the seal off the sealing surface and/or the seal provides a larger flow cross-section for the fluid when, for example, the fluid flows from the shaft seal to the refining chamber. When the seal lifts off the sealing surface and/or the flow cross-section of the fluid is enlarged, sliding friction in particular between seal and sealing surface is prevented or reduced, enhancing smooth movement of the shaft in the axial direction of the shaft. The seal is designed advantageously with a sealing lip, the sealing lip having a truncated cone shape in order to create a sealing effect that depends on the direction of flow. In order to create a seal towards the rotating shaft, for example between shaft bearing and refining chamber, a seal with a truncated cone-shaped sealing lip can be disposed such that the shaft runs inside the seal, the axial direction of the shaft and the axis of the truncated cone-shaped sealing lip coinciding with one another. In a first example, the seal would be mounted in the bearing housing and the truncated cone-shaped sealing lip would be pressing onto the shaft. Then the fluid flowing from the base to the imaginary tip of the truncated cone-shaped sealing lip would cause the sealing lip to expand and the seal to lift off the shaft, or at least reduce the pressing force of the seal, which is important for the seal and the sliding friction, against the sliding surface, or rather shaft. If the flow direction in this first example is reversed—i.e. the fluid flows from the imaginary tip of the cone to the base of the truncated cone-shaped sealing lip—the fluid would press the sealing lip against the shaft and increase the pressing force of the sealing lip. In a second example, the seal would be mounted on the shaft, for example, and the truncated cone-shaped sealing lip would be facing towards the bearing housing. If the fluid then flows from the base to the imaginary tip of the truncated cone-shaped sealing lip, this would cause the base surface to expand, thus increasing the pressing force of the sealing lip and enhancing the sealing effect towards the bearing housing. Seals with a sealing effect that depends on the direction of flow of the fluid are advantageous because the seal can achieve very little or no friction losses if the fluid flows in the desired direction of flow. However, the best possible seal is obtained if the direction of flow is reversed, and any fluid flow in the opposite direction to the desired direction of flow is reduced or prevented.

A similarly favourable design of the refiner is characterized in that the seal has a lesser sealing effect if the fluid flows through the shaft seal into the refining chamber than if the fluid flows out of the refining chamber into the shaft seal. Seals with a sealing effect that depends on the direction of flow of the fluid are advantageous because they permit very little or no friction losses by the seal if the fluid flows according to the desired direction of flow out of the shaft seal and into the refining chamber. If the direction of flow is reversed, this behaviour is advantageously reversed because the best possible seal is needed if the fluid flows out of the refining chamber and into the shaft seal, particularly to prevent the fibre pulp suspension from flowing out of the refining chamber and into the shaft seal and the shaft seal thus being contaminated by the pulp.

Another favourable embodiment of the refiner is characterized in that a damping element is assigned to the shaft bearing, the damping element being disposed between the rotor disc and a motor, preferably between the rotor disc and a coupling, the coupling being disposed between the rotor disc and the motor. The disclosed bearing permits such smooth movement of the shaft in axial direction that the sudden, abrupt movements by the shaft that can occur during operation are avoided. For example, when the fibre pulp suspension feed to the refiner begins, there can be a resulting force acting on the rotor disc and thus on the shaft that causes an abrupt movement by the shaft. Similarly, there can also be a resulting force acting on the rotor disc or the shaft during operation. The coupling can provide a slight damping effect, e.g. by the action of friction in the coupling. However, this is not enough, so it is an advantage to include a damping element to ensure uniform shaft movements in axial direction.

An advantageous embodiment of the refiner is characterized in that the damping elements are connected hydraulically to the shaft bearing. The damping element comprises a damping area, for example, and a throttling element. The throttling element can be a throttle ring, for example, disposed between shaft and bearing housing and largely covering the gap between shaft and bearing housing. The damping area is formed, for example, by an area between shaft, bearing housing and throttling element, the damping area being disposed between shaft bearing and coupling. Here, the damping element is connected hydraulically to the shaft bearing, i.e. the fluid—preferably water—that can be fed to the shaft bearing is also fed to the damping element, where continuous stream filaments of the fluid can be presented between the shaft bearing, i.e. the fluid feed to the shaft bearing, and the damping element. If the shaft moves in axial direction, the volume of the damping area changes, with fluid flowing into the damping area via the throttle element if the volume increases and out of the damping area via the throttle element if the volume decreases. This results in a damping effect in accordance with the viscosity losses of the fluid when passing through the damping element. It is advantageous to arrange the damping element between the bearing and the coupling because there is no hydraulic influence on the seal when the bearing is disposed between the seal and the damping element.

A similarly advantageous embodiment of the refiner is characterized in that the fibre pulp suspension can be fed to the refining chamber through an inlet area or through the shaft. This advantageous bearing permits shaft diameters that can be used to feed the fibre pulp suspension through the shaft into the refining chamber, and larger shaft diameters can also be implemented in a way that is technically feasible, unlike when using conventional anti-friction bearings.

Another advantageous embodiment of the refiner is characterized in that the rotor disc contains openings, these openings providing even distribution of the fibre pulp suspension in the refining chamber, which can be fed in through the inlet area or shaft. Advantageously, the fibre pulp suspension is fed to the refiner on one side of the rotor disc, the fibre pulp suspension being guided directly into a first gap between a first stator disc and the rotor disc. The fibre pulp suspension can also be fed through the openings in the rotor disc to the second side of the rotor disc, where the fibre pulp suspension can be guided into a second gap between a second stator disc and the rotor disc.

An advantageous embodiment of the refiner is characterized in that the shaft is connected via a coupling to a motor, where the shaft movement in axial direction can be absorbed by the coupling. As the motor is disposed rigidly and the shaft is advantageously movable in axial direction, any relative movement in axial direction between shaft and motor can be absorbed via the coupling.

A particularly advantageous embodiment of the refiner is characterized in that the coupling is designed as a curved teeth coupling and a radial and/or axial movement of the shaft is possible in the curved teeth coupling. Here, the shaft is connected to the motor with external toothing in the area of the coupling and via an intermediate coupling piece with internal toothing. When maintenance is required, very good access to the refiner is obtained by dismounting the intermediate piece. Curved teeth couplings enable the shaft to move in radial direction as well as in axial direction. In addition, curved teeth couplings enable the outer toothing of the shaft and the inner toothing of the intermediate coupling piece to make a swaying movement when the shaft rotates, with permanent sliding friction between the toothings. Thus, there is no initial static friction in the coupling if there is relative axial movement between the shaft and the motor during rotation of the shaft because there is always sliding friction in the coupling between the toothings. As a result, particularly smooth shaft movement is possible in axial direction.

BRIEF DESCRIPTION OF THE DRAWINGS

The invention will now be described using the examples in the drawings.

DETAILED DESCRIPTION

Figure 1:
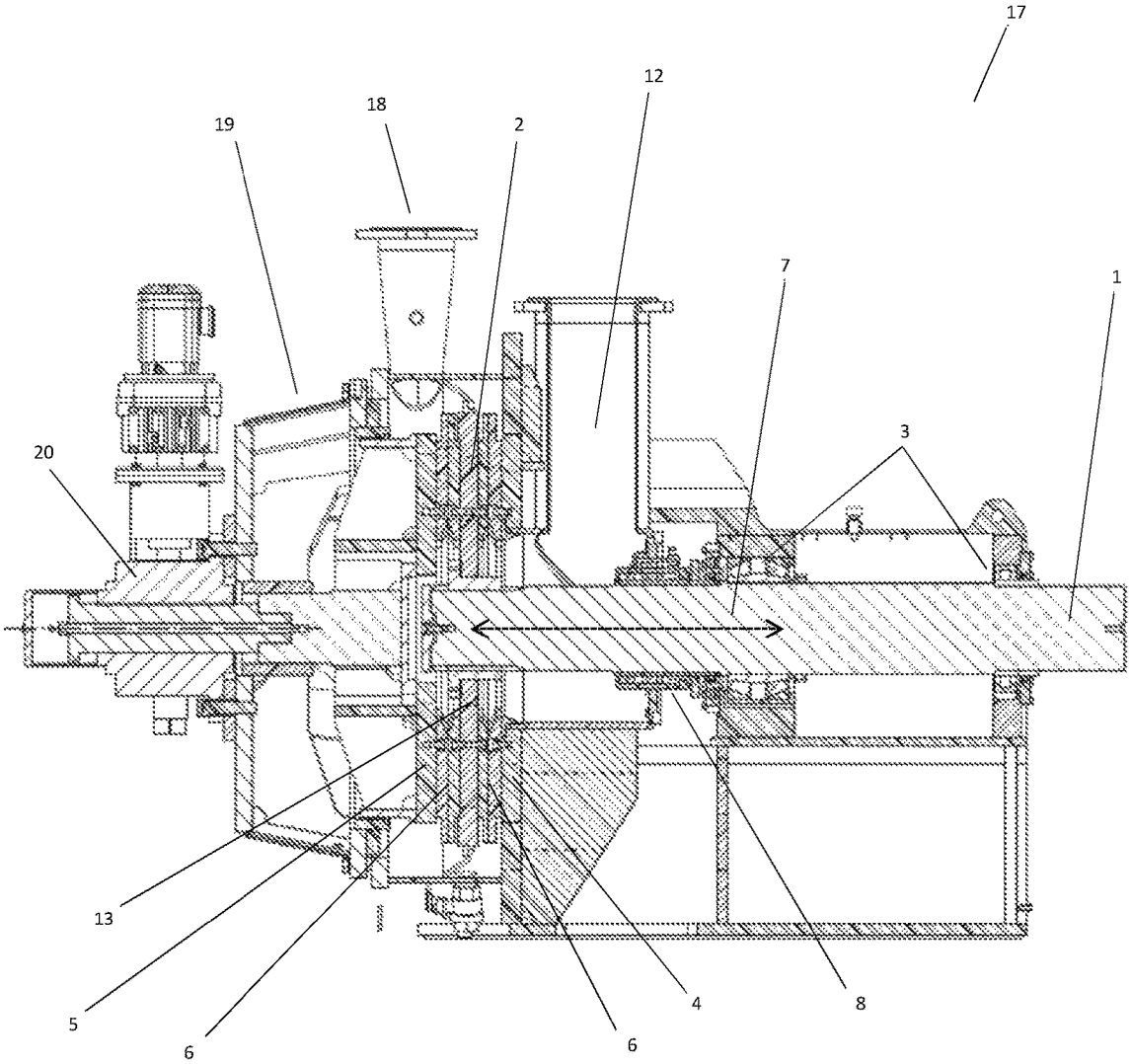
Fig. 1 (Prior Art)
FIG. 1 shows a refiner according to the state of the art.

FIG. 1 shows a refiner according to the state of the art. Here, a rotor disc 2 is disposed on a shaft 1 in a housing 19, the rotor disc 2 being movable in axial direction 7 in relation to the shaft 1. The fibre pulp suspension is fed to the refiner 17 through an inlet area 12 and distributes itself in the refining chamber 6 through openings 13 (not shown) in the rotor disc 2. Here, the fibre pulp suspension is refined in a first refining gap between the rotor disc 2 and the first stator disc 4 and in a second refining gap between the rotor disc 2 and the second stator disc 5 and leaves the refiner 17 through the outlet area 18. Exchangeable refiner plates are disposed on the rotor disc 2 and the stator discs 4, 5. The second stator disc 5 can be moved in axial direction by means of an adjusting device 20, and the spacing between the stator discs 4, 5 and between the rotor disc 2 and the stator discs 4, 5, respectively, can be set. The axial movement of the rotor disc 2 on the shaft permits autonomous centering of the rotor disc 2 between the two stator discs 4, 5, where comparable refining gaps form. This design of refiner 17 does not provide for any movement by the shaft 1 in axial direction 7, the shaft bearing 3 being designed as an anti-friction bearing. The shaft bearing 3 and the refining chamber 6 are clearly separated. The anti-friction bearings are oil-lubricated. A seal 8 seals off the refining chamber 6 and the inlet area 12 towards the shaft 1. The design should prevent any oil from entering the refining chamber 6, and no fibre pulp suspension should be able to enter the oil circulating system for the anti-friction bearing.

Figure 2:
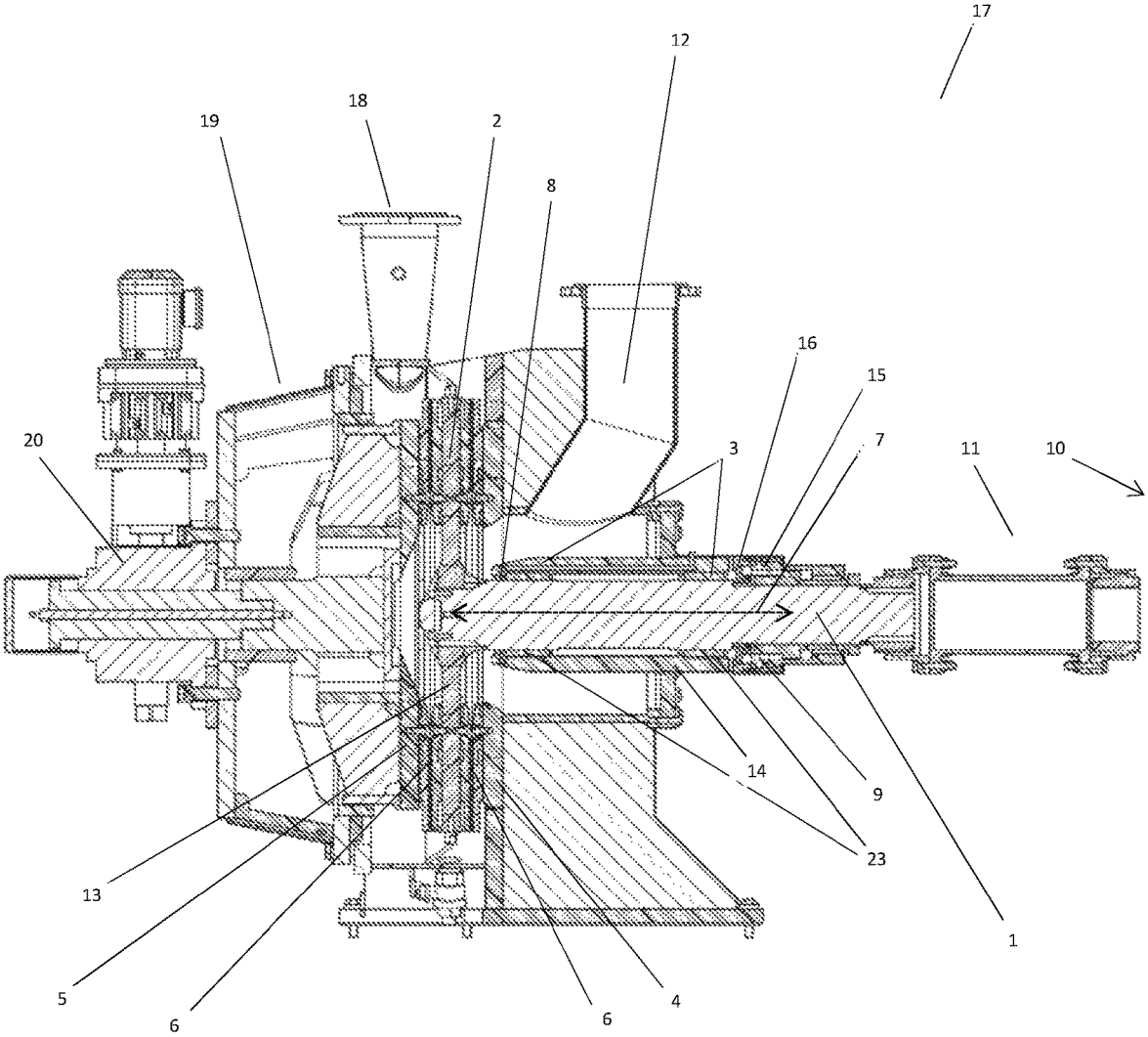
FIG. 2 shows an embodiment of a refiner according to the disclosure.
Figure 3:
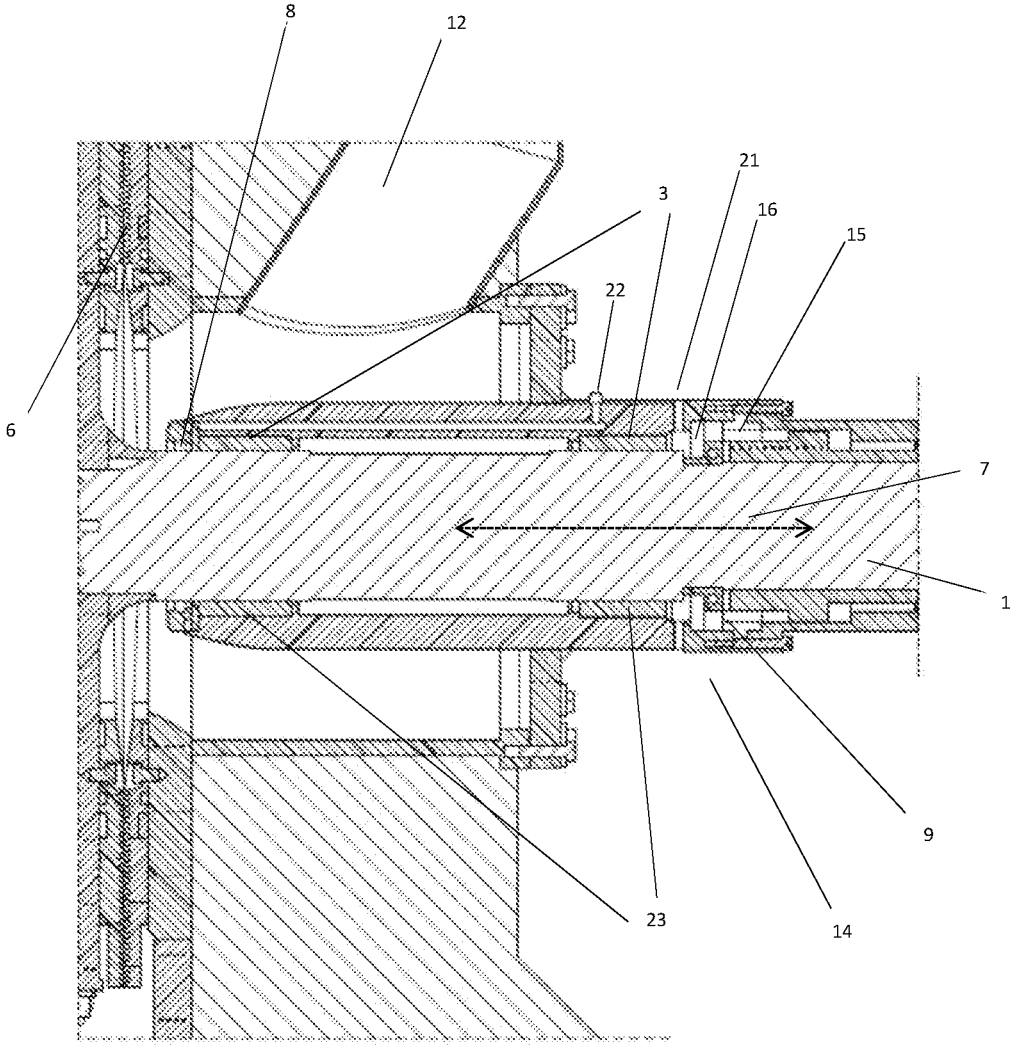
FIG. 3 shows details of the shaft bearing according to the disclosure.

FIG. 2 shows a refiner in an overhung arrangement. Here, a rotor disc 2 is disposed on a shaft 1 in a housing 19, the rotor disc 2 being firmly attached to the shaft 1 and the shaft 1 being movable in axial direction 7. The fibre pulp suspension is fed to the refiner 17 through an inlet area 12 and distributes itself in the refining chamber 6 through openings 13 (not shown) in the rotor disc 2. Here, the fibre pulp suspension is refined in a first refining gap between the rotor disc 2 and the first stator disc 4 and in a second refining gap between the rotor disc 2 and the second stator disc 5 and leaves the refiner 17 through the outlet area 18. Exchangeable refiner plates are disposed on the rotor disc 2 and the stator discs 4, 5. The second stator disc 5 can be moved in axial direction via an adjusting device 20, and the spacing between the stator discs 4, 5 and between the rotor disc 2 and the stator discs 4, 5, respectively, can be set. The axial movement of the shaft 1 and thus of the rotor disc 2 firmly attached to the shaft 1 permits autonomous centering of the rotor disc 2 between the two stator discs 4, 5, with comparable refining gaps forming. The rotor disc (2) is movable between the stator discs (4, 5) by movement of the shaft (1) in the axial direction (7). In accordance with movement of the shaft 1 in axial direction 7, the shaft 1 is connected to a motor 10 (not shown) via a coupling 11, the coupling 11 being able to absorb the movement of the shaft 1 in axial direction 7. The shaft 1 is mounted in an overhung arrangement by means of a shaft bearing 3, the rotor disc 2 being disposed outside the shaft bearing 3. The shaft bearing 3 is connected hydraulically to the refining chamber 6. Here, the shaft bearing 3 is designed as a fluid-lubricated plain bearing 23, where a fluid-preferably water-serves as lubricant in the shaft bearing 3 and can be at least partly fed to the refining chamber 6 through the shaft bearing 3. The seal 8 disposed between the shaft bearing 3 and the refining chamber 6 limits the amount of fluid flowing according to the pressure conditions between the shaft bearing 3 and the refining chamber 6. Advantageously, the fluid is guided systematically out of the shaft bearing 3 towards the refining chamber 6. This is achieved by the higher pressure of the fluid in the shaft bearing 3 compared to the pressure in the refining chamber 6. In this way, no fibre pulp suspension and no pulp from the refining chamber 6 can enter the shaft bearing 3. It is also appropriate to implement a seal 8 with a sealing effect that depends on the flow direction of the fluid. A seal 8 that has a lesser sealing effect when the fluid flows through the shaft bearing 3 into the refining chamber 6 than when the fluid flows out of the refining chamber 6 into the shaft bearing 3 is particularly advantageous. Thus, if there is higher pressure in the refining chamber 6 and lower pressure in the shaft bearing 3, fibre pulp suspension flowing from the refining chamber 6 into the shaft bearing 3 can be reduced to a minimum or prevented entirely. Advantageously, the refiner 17 also comprises a damping element 9 for the shaft bearing 3. The damping element 9 is disposed between rotor disc 2 and motor 10 (not shown) and preferably between rotor disc 2 and coupling 11. The damping element 9 can be connected hydraulically to the shaft bearing 3, the damping element 9 comprising a damping area 15 and a throttle element 16. The fluid fed to the shaft bearing 3 flows through the shaft bearing 3 here and also fills the damping area 15. The volume of the damping area 1 can be changed by moving the shaft 1 in axial direction 7, where fluid flows towards the damping element 9 when the volume of the damping area 15 increases and fluid flows away from the damping element 9 when the volume of the damping area 15 decreases, the fluid flowing towards and away from the damping area 15 through the throttle element 16 in each case FIG. 3 shows details of an overhung shaft bearing 3 according to the disclosed embodiments. The fluid is fed to the shaft bearing 3 though a fluid inlet 21 and flows through the fluid-lubricated plain bearing 23, filling the damping area 15. The seal 8 is disposed between shaft bearing 3 and refining chamber 6 and restricts the amount of fluid flowing in accordance with the pressure conditions between shaft bearing 3 and refining chamber 6, the greater part of the fluid being discharged from the shaft bearing 3 through the fluid return line 22. Advantageously, the fluid is guided systematically towards the refining chamber 6 by the fluid having a higher pressure in the shaft bearing 3 compared to the pressure in the refining chamber 6. The damping element 9 is connected hydraulically to the shaft bearing 3 and comprises the damping area 15 and the throttle element 16. The throttle element 16 is connected to the shaft 1 in FIG. 3, the damping area 15 being delimited by the shaft 1, the bearing housing 14 and the throttle element 16. The volume of the damping area 15 can be changed by moving the shaft 1 in axial direction 7, where fluid flows towards the damping element 9 when the volume of the damping area 15 is increased and fluid flows away from the damping element 9 when the volume of the damping area 15 decreases, the fluid flowing towards and away from the damping area 15 through the throttle element 16 in each case.

Figure 4A:
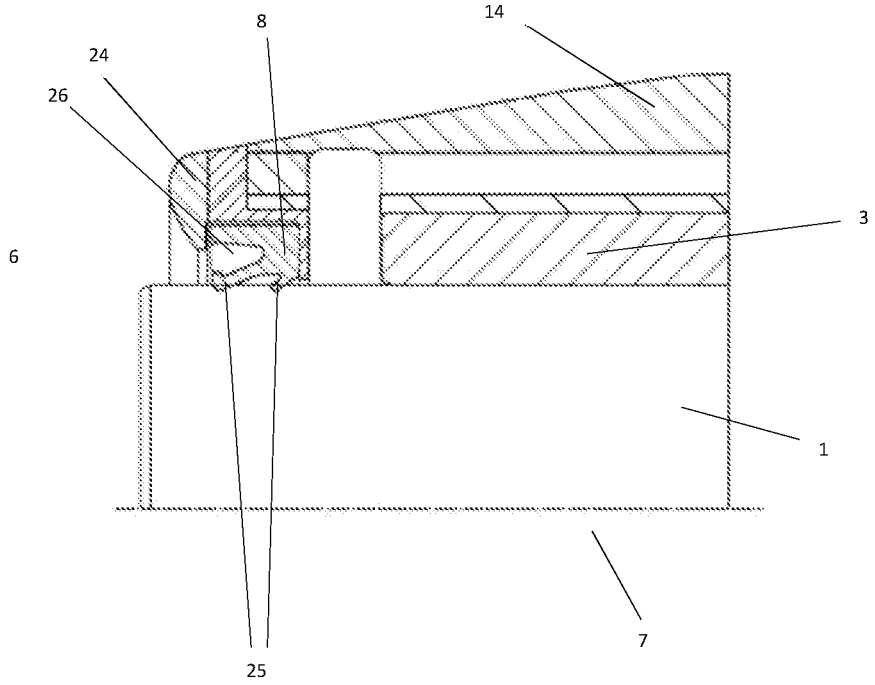
FIGS. 4A and 4B show advantageous seals.
Figure 4B:
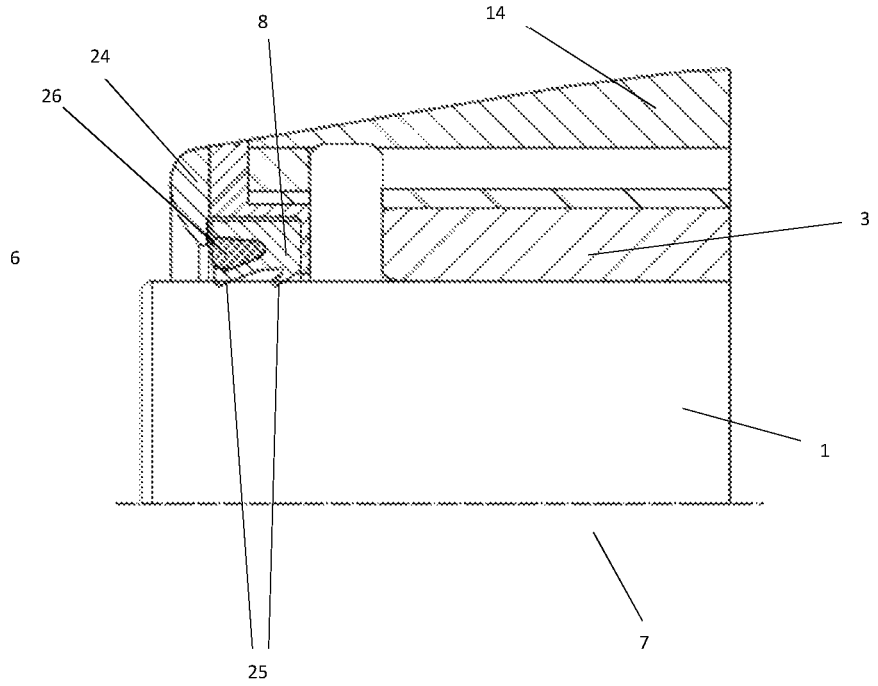

FIGS. 4A and 4B each show an advantageous seal 8 for the shaft bearing 3 that enables a sealing effect dependent on the flow direction of the fluid. The seal 8 is secured in the bearing housing 14 by a fastening element 24, the sealing lips 25 facing the shaft 1. In accordance with the truncated cone shape of the sealing lips 25, a lesser sealing effect is obtained when the fluid flows through the shaft bearing 3 into the refining chamber 6 than when the fluid flows out of the refining chamber 6 into the shaft bearing 3. The fluid flowing from the base to the imaginary tip of the truncated cone-shaped sealing lip 25—and thus from the shaft bearing 3 towards the refining chamber 6—causes the sealing lip 25 to expand and the sealing lip 25 to lift off the shaft 1, or at least reduces the pressing force of the seal 8, which is important for the seal 8 and the sliding friction, against the shaft. If the direction of flow is reversed, i.e. the fluid flows from the imaginary tip of the cone to the base of the truncated cone-shaped sealing lip 25—or from the refining chamber 6 towards the shaft bearing 3—the fluid presses the sealing lip 25 against the shaft 1 and causes the pressing force of the sealing lip 25 on the shaft 1 to increase. FIG. 4A shows a seal 8 with two free-standing sealing lips 25. FIG. 4B shows a seal 8 with two sealing lips 25, one free-standing sealing lip 25 being disposed closer to the shaft bearing 3 and the sealing lip 25 that is disposed closer to the refining chamber 6 having no cavity 26 facing towards the refining chamber 6, which advantageously avoids pulp being deposited there and possibly hardening of pulp in the cavity 26 facing the refining chamber 6.

The disclosed embodiments thus offer numerous advantages. The lower wear on the rotor discs and stator discs—especially on the refiner plates on these discs—achieved by very smooth positioning of the rotor disc, which is also retained in continuous operation, is particularly advantageous. Here, the disclosed embodiments prevent any contamination by pulp in the area of the seal and the bearing. Similarly, the disclosed bearing avoids the risk of oil contaminating the fibre pulp suspension because the bearing can be operated without oil, as well as eliminating or minimizing the risk of the pulp contaminating the bearing. The bearing also permits a more compact refiner design and, above all, a shorter overall length.

REFERENCE NUMERALS (1) Shaft
(2) Rotor disc
(3) Shaft bearing
(4) First stator disc
(5) Second stator disc
(6) Refining chamber
(7) Axial direction
(8) Seal
(9) Damping element
(10) Motor
(11) Coupling
(12) Inlet area
(13) Openings
(14) Bearing housing
(15) Damping area
(16) Throttling element
(17) Refiner
(18) Outlet area
(19) Housing
(20) Adjusting device
(21) Fluid inlet
(22) Fluid return line
(23) Fluid-lubricated plain bearing
(24) Fastening element
(25) Sealing lip
(26) Cavity

The invention claimed is:

1. A refiner for refining pulps in a fiber pulp suspension, comprising:

a shaft (1) extending in an axial direction and being movable in the axial direction (7);

a rotor disc (2) attached to the shaft (1);

a shaft bearing (3) associated with the shaft (1); and two stator discs (4, 5) forming a refining chamber (6) between them, at least one of the stator discs (4, 5) being slidable in the axial direction (7) and the refining chamber (6) having an adjustable size via adjustment of a spacing between the respective stator discs (4, 5), wherein the rotor disc (2) is disposed between the two stator discs (4, 5), the rotor disc (2) is movable between the stator discs (4, 5) by movement of the shaft (1) in the axial direction (7), and the shaft bearing (3) is connected hydraulically to the refining chamber (6).

2. The refiner according to claim 1, wherein the rotor disc (2) is attached to the shaft (1) at an axial position inside or outside the shaft bearing (3).

3. The refiner according to claim 1, wherein the shaft bearing (3) is a fluid-lubricated plain bearing (23), wherein a fluid can be fed to the refining chamber (6) via the shaft bearing (3).

4. The refiner according to claim 3, wherein the fluid is water.

5. The refiner according to claim 1, comprising a seal (8) positioned between the refining chamber (6) and the shaft bearing (3).

6. The refiner according to claim 5, wherein the seal (8) exhibits a first sealing effect when the fluid flows in a relative direction through the shaft bearing (3) into the refining chamber (6) and exhibits a second sealing effect when the fluid flows in a relative direction out from the refining chamber (6) into the shaft bearing (3), the second sealing effect being different than the first sealing effect.

7. The refiner according to claim 6, wherein the rotor disc (2) is attached to the shaft (1) at an axial position inside or outside the shaft bearing (3).

8. The refiner according to claim 6, wherein the shaft bearing (3) is a fluid-lubricated plain bearing (23), wherein a fluid can be fed to the refining chamber (6) via the shaft bearing (3).

9. The refiner according to claim 8, wherein the second sealing effect is greater than the first sealing effect.

10. The refiner according to claim 6, wherein the second sealing effect is greater than the first sealing effect.

11. The refiner according to claim 6, comprising a damping element (9) associated with the shaft bearing (3) and disposed between the rotor disc (2) and a motor (10).

12. The refiner according to claim 1, comprising a damping element (9) associated with the shaft bearing (3) and disposed between the rotor disc (2) and a motor (10).

13. The refiner according to claim 12, comprising a coupling (11) disposed between the rotor disc (2) and the motor (10), wherein the damping element (9) is disposed between the rotor disc (2) and a coupling (11).

14. The refiner according to claim 12, wherein the damping element (9) is hydraulically connected to the shaft bearing (3).

15. The refiner according to claim 1, wherein the fiber pulp suspension can be fed to the refining chamber (6) through an inlet area (12) or through the shaft (1).

16. The refiner according to claim 15, wherein the rotor disc (2) include openings (13) that provide even distribution of the fiber pulp suspension in the refining chamber (6) being fed through the inlet area (12) or shaft (1).

17. The refiner according to claim 1, wherein the shaft (1) is connected via a coupling (11) to a motor (10) and movement of the shaft (1) in the axial direction (7) can be absorbed by the coupling (11).

18. The refiner according to claim 6, wherein the shaft (1) is connected via a coupling (11) to a motor (10) and movement of the shaft (1) in the axial direction (7) can be absorbed by the coupling (11).

19. The refiner according to claim 17, wherein the coupling (11) is a curved-teeth coupling, allowing radial and axial movement of the shaft is possible in the curved-teeth coupling.

20. The refiner according to claim 1, wherein the shaft (1) is supported entirely on fluid-lubricated plain bearings (23).

* * * * *